US008128992B1

(12) United States Patent
Tobbe et al.

(10) Patent No.: US 8,128,992 B1
(45) Date of Patent: Mar. 6, 2012

(54) METHOD FOR INSULATING AN APPLIANCE WITH AN EXPANDING INSULATING MATERIAL

(75) Inventors: Joseph Anthony Tobbe, Louisville, KY (US); Nicholas David Tackett, Louisville, KY (US); Roger Shawn Nelson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/088,670

(22) Filed: Apr. 18, 2011

(51) Int. Cl.
*B05D 7/22* (2006.01)
*F25D 23/06* (2006.01)

(52) U.S. Cl. ..... 427/230; 427/236; 427/243

(58) Field of Classification Search ..... 427/230–239, 427/243; 220/592.01, 592.02, 592.09, 592.1, 220/592.25
See application file for complete search history.

(56) References Cited

U.S. PATENT DOCUMENTS

| | | | | |
|---|---|---|---|---|
| 4,037,754 | A * | 7/1977 | Wilhelmi et al. | 220/254.2 |
| 4,903,858 | A | 2/1990 | Clark et al. | |
| 4,974,914 | A | 12/1990 | Jenkins | |
| 5,584,551 | A | 12/1996 | Jenkins | |
| 5,740,074 | A * | 4/1998 | Wang et al. | 700/266 |
| 6,221,484 | B1 * | 4/2001 | Leiter | 428/343 |

FOREIGN PATENT DOCUMENTS

JP 10-253246 A * 9/1998

* cited by examiner

*Primary Examiner* — William Phillip Fletcher, III
(74) *Attorney, Agent, or Firm* — Dority & Manning, P.A.

(57) ABSTRACT

A method for filling the internal cavity of an appliance cabinet with an expanding foam material includes defining a pattern of fill holes in the outer cabinet wall at defined locations for injecting foam into identified sections of the cavity. Measured quantities of the foam material are injected into the fill holes in a sequential manner starting at one end of the cabinet and working towards an opposite end of the cabinet so as to sequentially deposit measured amounts of the foam material into the cavity against previously deposited sections of foam along the length of the cabinet while driving air within the cabinet towards a last section of the cabinet to be filled.

10 Claims, 5 Drawing Sheets

METHOD FOR INSULATING AN APPLIANCE WITH AN EXPANDING INSULATING MATERIAL

FIELD OF THE INVENTION

The present subject matter relates generally to consumer appliances, such as refrigerators, and more particularly to a method for injecting an expandable insulation material into the appliance cabinet.

BACKGROUND OF THE INVENTION

It is a common manufacturing practice to inject an expandable foam material, such as a polyurethane foam, into the double wall cabinet of a refrigeration appliance, such as a refrigerator or freezer, to provide a desired degree of thermal insulation to the appliance. Known foam injecting methods include mixing a predetermined amount of the starting chemicals and injecting them at a predetermined location within the double-wall of the cabinet from which location the foaming process essentially begins. The foaming mixture then expands within the double-wall of the cabinet flowing throughout and between the double-wall of the cabinet's two exterior side panels, exterior top and bottom panels, exterior back panel, and any interior rib panel. Before the start of the fill process, a venting hole is created at a predetermined location in the compartment cavity to release air trapped ahead of the advancing foam. Other venting holes may be required at different predetermined locations to avoid any pockets of trapped air, which cannot be filled with foam. Preheating of a compartment cavity may be necessary to increase the activity of the foaming mixture to flow throughout the cavity.

The prior foaming techniques often result in uneven distribution of the foam within the various contours and spaces of the double-wall cabinet, as well as the formation of air pockets, resulting in decreased insulation performance. In addition, the density of the foam material at various locations cannot be controlled and can vary widely.

Accordingly, an improved method for filling the cabinet of a consumer appliance with expandable foam is desirable.

BRIEF DESCRIPTION OF THE INVENTION

Aspects and advantages of the invention will be set forth in part in the following description, or may be obvious from the description, or may be learned through practice of the invention.

In accordance with aspects of the invention, a method is provided for filling the internal cavity of an appliance cabinet with an expanding foam insulation material. Although the method is particularly suited for refrigerator cabinets, it should be appreciated that the invention is not limited to any particular type of appliance. The method includes defining a pattern of fill holes in an outer wall of the appliance cabinet at defined locations for injecting foam into identified sections of the cavity (which may overlap). For example, particular fill holes may be provided for filling the back panel section of the cabinet, while other holes are provided for filling the side panel sections and the top and bottom panel sections. Measured quantities of the foam material are injected into the fill holes in a sequential manner starting at one end of the cabinet and working towards an opposite end of the cabinet. In this manner, measured amounts of the foam material are sequentially deposited into the cavity against previously deposited sections of foam along the length of the cabinet while driving air within the cabinet towards a last section of the cabinet to be filled or out of vent holes in the cabinet.

A plurality of vent holes may be defined in the outer cabinet wall spaced apart along the longitudinal length of the cabinet and in any desired pattern to allow air to escape from the cabinet as the cabinet sections are individually and sequentially filled.

In a particular embodiment, the amount and/or viscosity of the foam material injected into each of the fill holes is determined so as to provide a uniform density of the foam material within each respective section. The density of the foam material may vary between different sections of the cabinet, for example by varying the viscosity or amount of the foam material injected into different sections of the cabinet. In a particular embodiment, for example, the appliance cabinet is for a refrigerator and the density of the foam material in the cabinet sections around the freezer compartment may be different than in the sections around the fresh food compartment.

The amount of foam material injected into each of the identified sections of the cabinet may be empirically determined, for example through a trial-and-error process. In an alternative embodiment, the amount of foam material for each section may be determined by computer modeling, which may be followed by actual physical verification.

The sequential injecting steps may be preformed so that the previously injected amount of foam material does not solidify to any substantial extent before the adjacent section of the cabinet is injected with foam material to prevent voids from forming between the adjacent sections of foam material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 2:
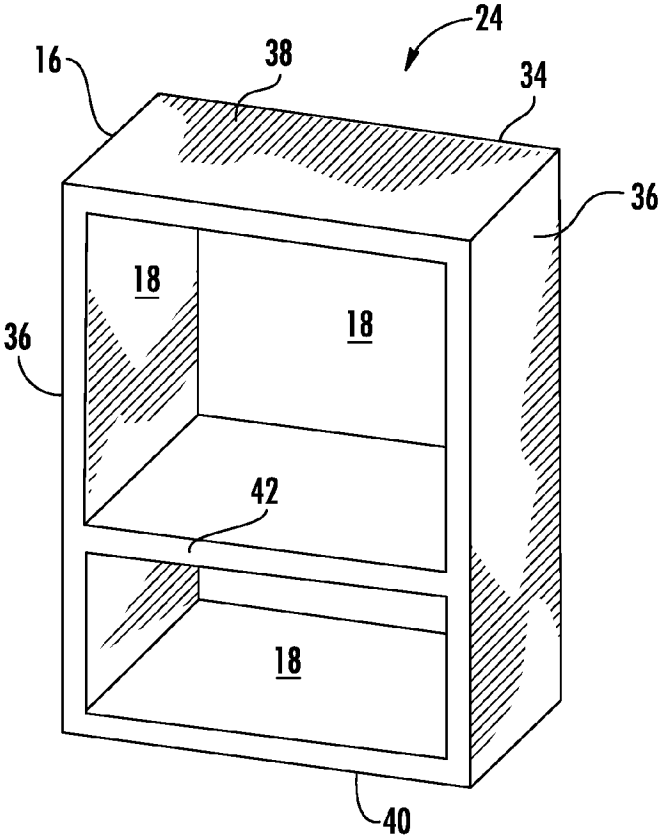
FIG. 2 is a perspective view of the cabinet from the refrigerator in FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 1:
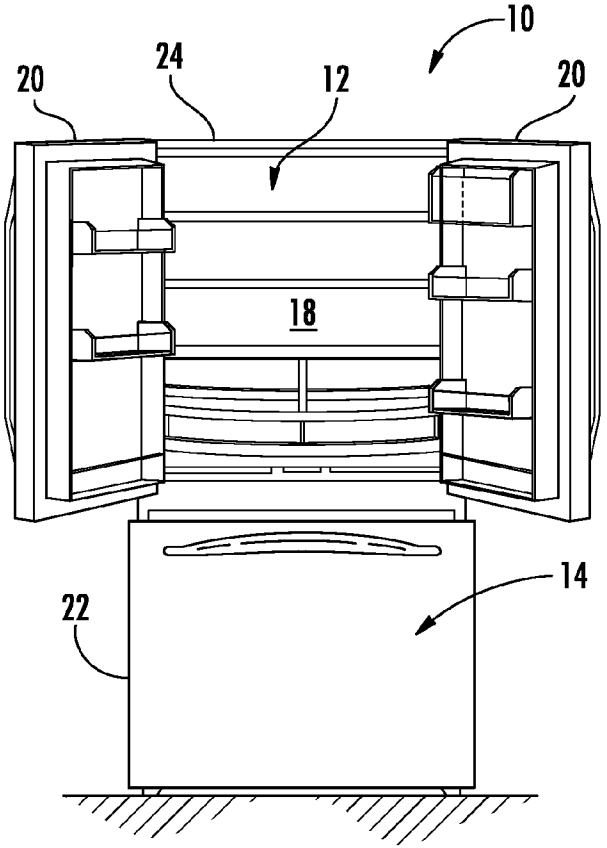
FIG. 1 is a front perspective view of a refrigeration appliance, in particular a refrigerator.

FIG. 1 is a perspective view of an exemplary refrigeration appliance 10 depicted as a conventional refrigerator. It should be appreciated that the refrigeration appliance of FIG. 1 is for illustrative purposes only. The present invention is not limited to any particular type, style, or configuration of refrigeration appliance, and such appliance may include any manner of refrigerator, freezer, refrigerator/freezer combination, and so forth.

Referring to FIG. 1, the refrigerator 10 includes a fresh food storage compartment 12 with doors 20 arranged above a freezer storage compartment 14 with door 22. The compartments 12, 14 are defined by a respective liner 18 within an outer case 16, which together define a cabinet 24 (FIG. 2). The liners 18 are typically molded from a suitable plastic material. The outer case 16 is normally formed by folding a sheet of a suitable material, such as pre-painted steel, into an inverted U-shape to form outer top, bottom, and side walls of the cabinet 24. A bottom wall of the outer case 16 is normally formed separately and attached to the case side walls and to a bottom frame that provides support for refrigerator 10.

FIG. 2 depicts the cabinet 24 of the refrigerator 10 in its basic form. The cabinet 24 includes a top panel section 38, side panel sections 36, a bottom panel section 40, a back panel section 34, and an internal rib 42. The liner 18 defines the internal compartments of the cabinet 24, as discussed above.

Figure 3:
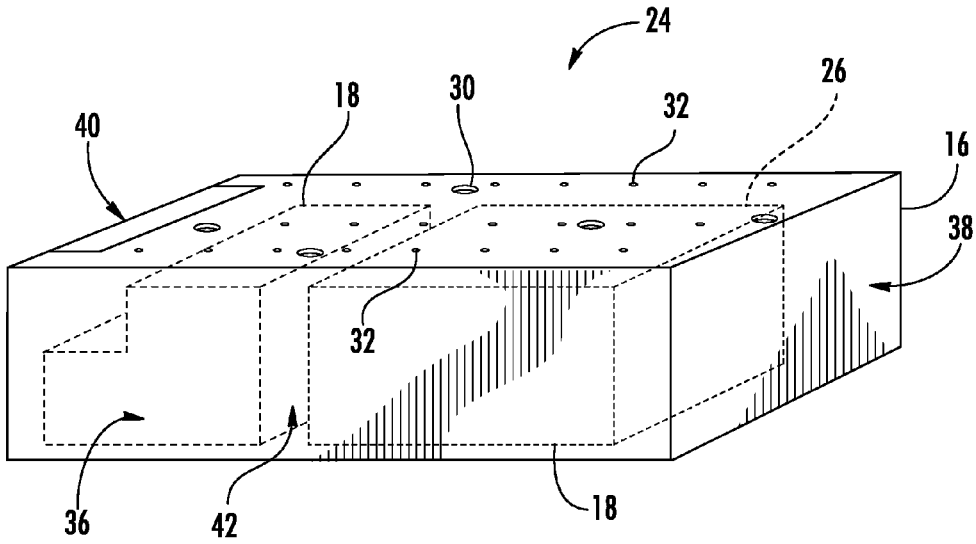
FIG. 3 is a back perspective view of the cabinet from FIG. 2 with a plurality of fill holes defined in the back panel section.

FIG. 3 depicts the cabinet 24 in a face-down position such that the back panel 34 defines an upper plane. The liner sections 18 are depicted in phantom within the cabinet 24. Internal cavities or spaces 26 are defined between the various sections of the case 16 and the liner sections 18. These internal cavity sections 26 are filled with an expandable foam insulation material in accordance with aspects of the invention.

Still referring to FIG. 3, a pattern of spaced apart fill holes 30 are defined in the outer casing wall 16 along the back panel section 34. These fill holes 30 are strategically located in a pattern that will provide for generally complete and uniform coverage of the injected foam material along defined sections of the cabinet 24. For example, particular fill holes 30 may be provided in the pattern for primarily filling the back panel section 34 of the cabinet, while other fill holes 30 may be strategically located for primarily filling the side panel sections 36, or the top and bottom panel sections 38, 40. It should be appreciated that the pattern of holes 30 depicted in FIG. 3 is for illustrative purposes only.

A plurality of smaller vent holes 32 are also defined in the back panel section of the casing 16. These vent holes 32 may be applied in a uniform or non-uniform pattern and serve to allow air to escape from the internal cavities 26 as the foam material advances through the spaces 26. The invention is not limited by any particular number, size, or location of the vent holes 32.

Figure 4:
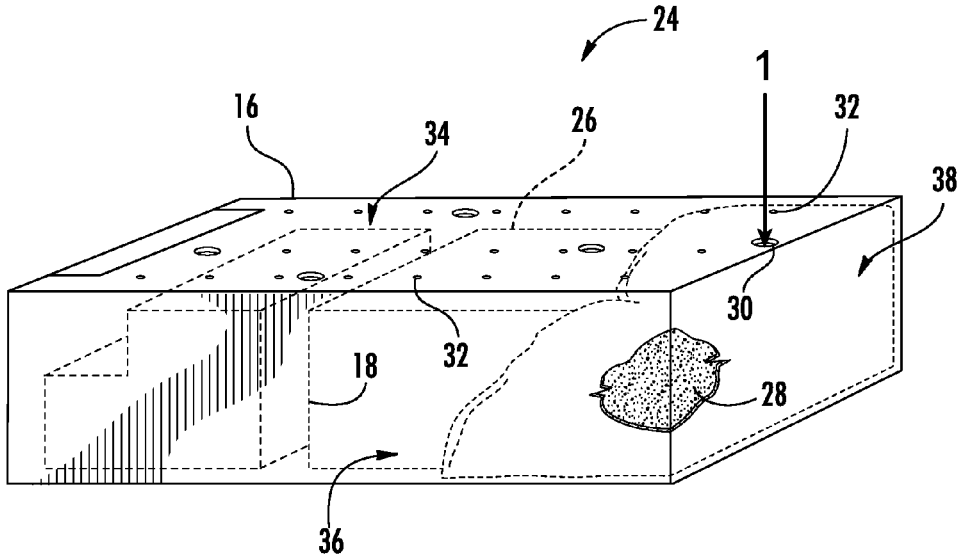
FIGS. 4 through 8 are sequential views of the foam injection process through the fill holes in the back panel section of the cabinet of FIG. 3.

Referring to FIG. 4, a point "1" of initial injection for an expandable foam material 28 is indicated at the fill hole 30 closest to one longitudinal end of the cabinet 24, in this example closest to the top panel section 38. It should be appreciated that an "end" also encompasses a side panel section 36. This particular vent hole 30 is located at a position such that the foam injected through the hole migrates into the internal cavity 26 along the top panel section 38, as well as partially onto the top panel section 34 and partially along the side panel section 36, as particularly illustrated by the phantom lines in FIG. 4. In other words, although there may be a primary target section for any individual fill hole 30, the foam injected into such hole may overlap into another section. As the foam material is injected into the fill hole 30, air from the internal cavity 26 is forced out in vent holes 32 or towards other un-filled sections of the internal cavity 26.

A measured quantity of the foam material 28 is injected into the fill hole 30 to achieve a desired thermal characteristic along the defined section of the cabinet 24. For example, the top panel section 38 is the top of the fresh food compartment 12 (FIG. 1). It may be desired that this particular section 38 of the cabinet 24 have a thermal insulation characteristic that may be different from the side panel sections 36 along the fresh food compartment, or side panel sections 36 along the freezer compartment 14, and so forth. Thus, the amount or viscosity of the foam material 28 injected into the first fill hole 30 may have certain characteristics tailored to achieve the desired thermal characteristics along the particular section 38.

Figure 5:
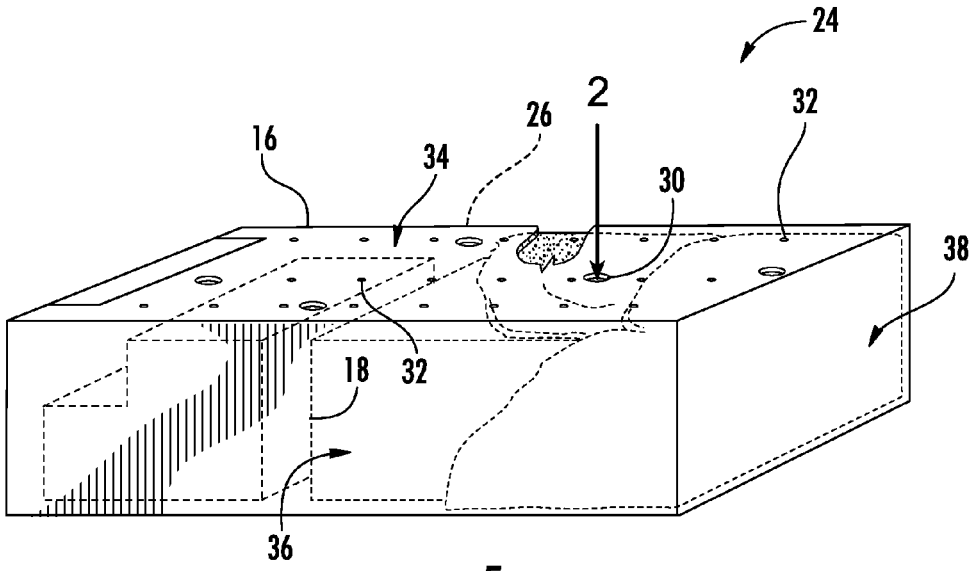

The distinct measured quantities of foam material 28 are injected into the fill holes 30 in a sequential manner starting at one end of the cabinet and working towards the opposite end of the cabinet 24. For example, referring to FIG. 5, the second point of injection "2" of the foam material 28 is indicated at the fill hole 30 that is strategically located to provide uniform foam distribution essentially along the remaining portion of the top panel section 34 for the fresh food compartment. As can be appreciated from FIG. 5, the measured amount of foam material 28 injected into this second fill hole 30 results in the foam material migrating directing against the previously deposited section of foam in one direction, and migrating along the back panel section 34 in the opposite longitudinal direction. Any air within the internal cavity 26 that is displaced by injection of the foam 28 vents through any one or combination of the vent holes 30 or is driven towards the opposite longitudinal end of the cabinet 24.

Figure 6:
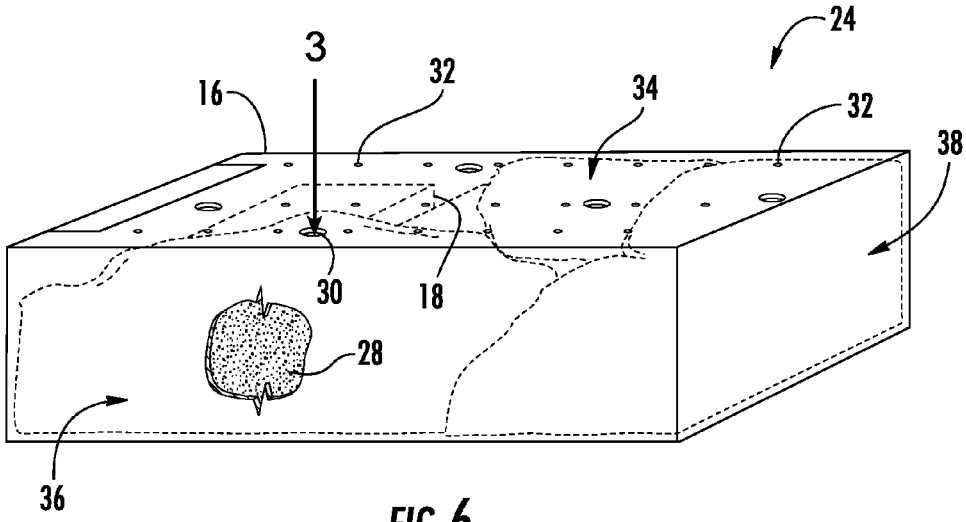

FIG. 6 depicts a next sequential step wherein a third fill hole 30 is injected with the foam material 28. This hole 30 is strategically located so as to uniformly distribute the foam material 28 along the remaining portions of the side panel section 36. As previously mentioned, the density of the foam material 28 along this section may be different than the density of the foam deposited along the back panel section 34 or the bottom panel section 38. The viscosity of the foam may be regulated to achieve the overall uniform density of the foam material 28 along this section, which may be different from the density of the foam in other sections.

The third fill hole 30 in FIG. 6 is also located so as to distribute the foam within the internal rib 42 of the cabinet 24. This rib 42 is the component that separates the freezer compartment 14 from the fresh food compartment 12 (FIG. 1). Again, the density of the foam 28 within this rib 42 may be different from other sections of the foam 28.

Figure 7:
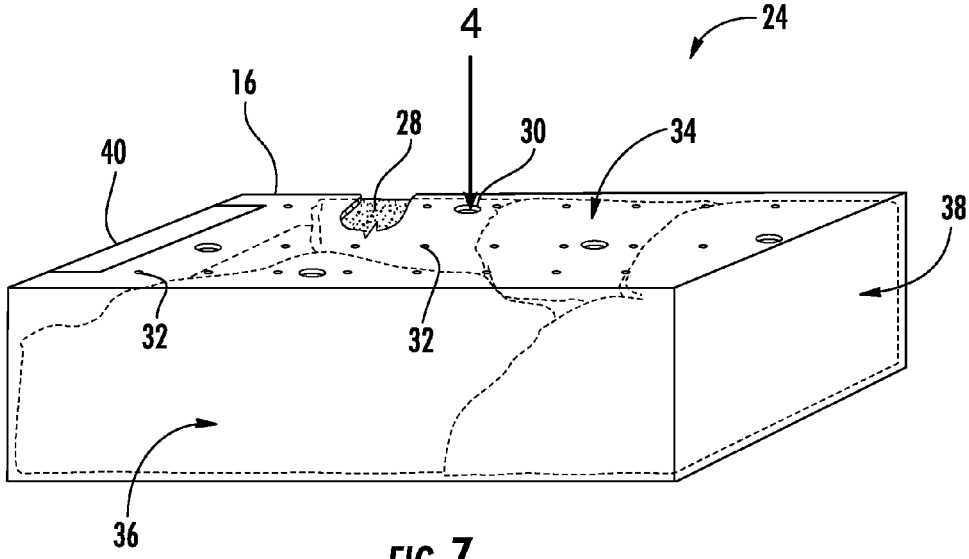

FIG. 7 depicts the next sequential step wherein a fourth fill hole 30 is injected with the foam 28 in order to fill any remaining section of the internal rib 42, as well as the opposite side panel section 36. The third and fourth fill holes 30 also serve to distribute the foam 28 along a section of the back panel section 34, as depicted in FIG. 7 by the phantom lines.

Figure 8:
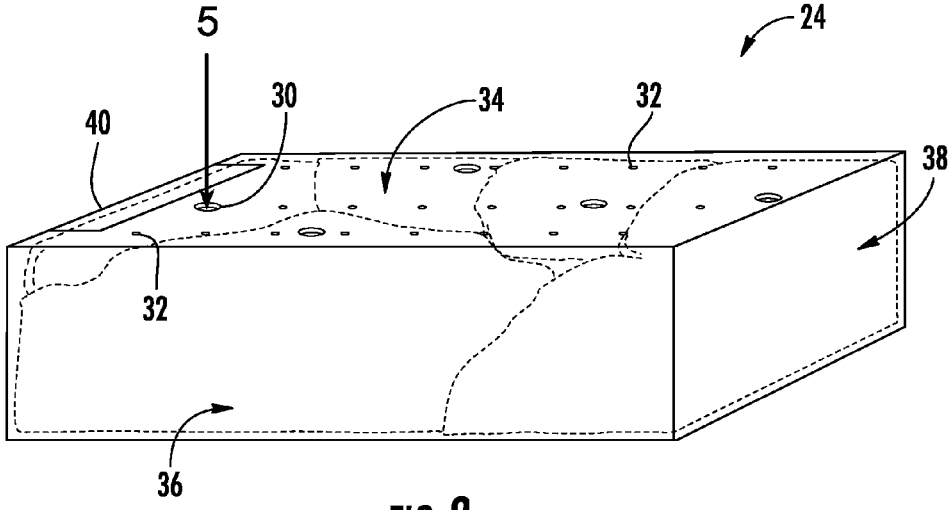

FIG. 8 depicts a next sequential step wherein a fifth fill hole 30 is injected with the foam material 28. This hole is strategically located to uniformly distribute the foam 28 along a section of the back panel 34 adjacent to the freezer compartment, as well as along the bottom panel section 40. It may be desired that the density of the foam in this area is greater than, for example, the density of the foam at the opposite top panel section 38.

It should be appreciated from the figures, that the identified "sections" of the cabinet 24 need not be well-defined. For example, it is difficult to control the migration of the foam 28 within the internal cavity spaces 26 without an inordinate amount of fill holes 30. However, the fill holes 30 can be strategically located so as to inject the foam material such that the foam migrates generally to an identified section of the cabinet, for example primarily along the top panel section, bottom panel section, and so forth. The holes may also serve to deposit the foam material 28 along different sections simultaneously. For example, as discussed above with respect to the third and fourth fill holes 30 in FIGS. 6 and 7 wherein the foam material migrates into the internal rib 42, as well as along a portion of the side panel sections 36.

The amount of foam material to be injected into each of the identified sections of the cabinet 24 may be determined in various ways. For example, the amount and viscosity of the foam material may be empirically determined based on a trial and error method wherein numerous cabinets 24 for a given refrigerator design are injected, allowed to solidify, and then cut open to record the results of the injection process.

In another embodiment, the amount and viscosity of the foam material for the different identified sections may be determined by computer modeling, or calculations based on the known dimensions of the various internal cavity spaces 26.

The sequential injecting steps may be performed so that the previously injected amount of foam material does not significantly solidify before the adjacent section of the cabinet is injected with foam material. This may be done to prevent the formation of voids or air pockets between the adjacent sections of foam material 28. Some degree of "skinning" may be acceptable between the adjacent foam sections without significant solidification of one section prior to injection of the next adjacent section.

Figure 11:
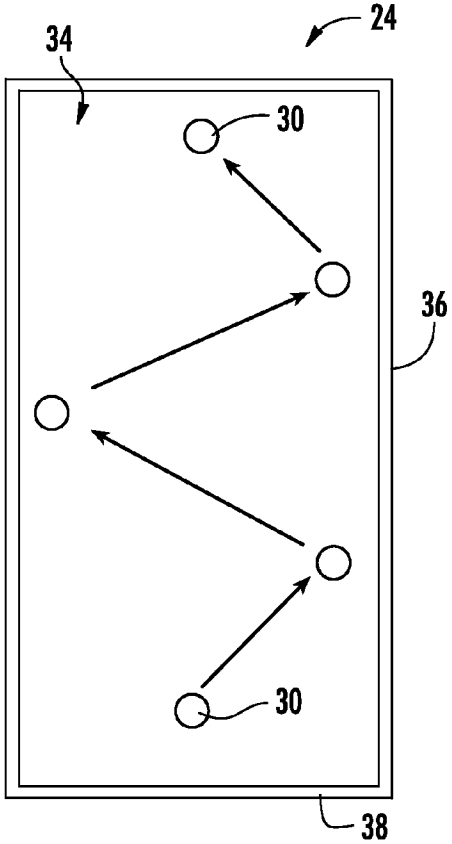
FIG. 11 is a diagram view of still another fill hole pattern.
Figure 10:
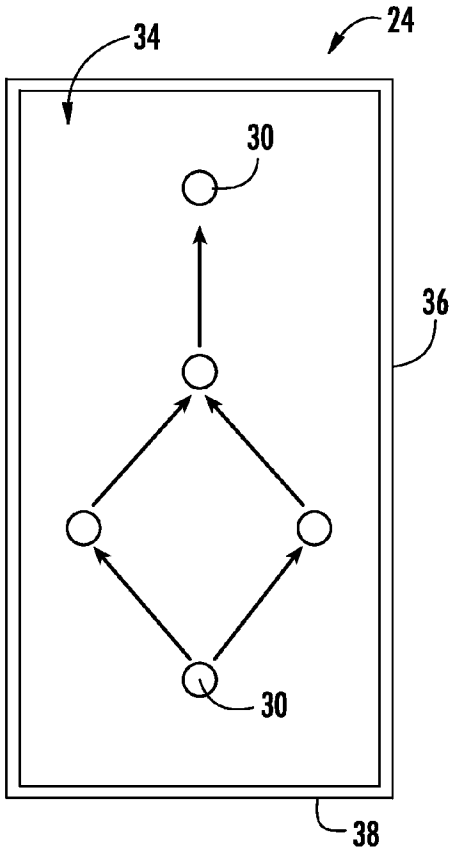
FIG. 10 is a diagram view of an alternative fill hole pattern.
Figure 9:
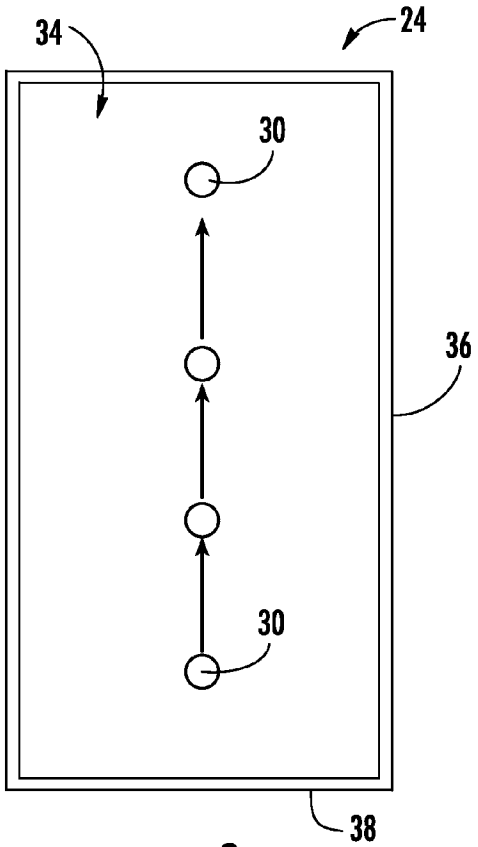
FIG. 9 is a diagram view of a fill hole pattern in one embodiment.

It should be appreciated that the invention is not limited to any particular number and configuration of fill holes 30. The location and number of holes 30 will depend on the design and structure of the particular refrigerator cabinet 24, as well as the desired thermal characteristics for the various cabinet sections. In this regard, FIGS. 9 through 11 depict different patterns of fill holes 30 that may be utilized. For example, FIG. 9 depicts a linear progression of fill holes 30 in a relatively straight line along the back panel section 34. The first fill hole 30 would be used to inject foam along the top panel section 38 and a portion of the back panel section 34 and side panel sections 36. The injection process proceeds from one longitudinal or side end of the cabinet 24 towards the opposite longitudinal or side end, as depicted by the arrows in FIG. 9. The next sequential fill hole 30 would result in application of the foam material along an adjacent section of the top panel section 34 and side panel sections 36, and so forth.

In the embodiment of FIG. 10, the first fill hole 30 would result in application of the foam material along the top panel section 38, side panel sections 36, and a portion of the back panel section 34. The next subsequent fill holes 30 in the longitudinal direction indicated by the arrows would primarily apply the foam material along the side panel sections 36 and a portion of the back panel section 34, wherein the combination of these two holes 30 would result in merger of the foam material along the back panel section 34. The remaining fill holes 30 would be used to apply the foam material along the internal rib section 42 of the cabinet 24, the remaining portions of the back panel section 34, the remaining portion of the side panel sections 36, and the bottom panel section 40.

In the embodiment of FIG. 11, the fill holes 30 are located so as to primarily fill the side sections 36 and the top and bottom panel sections 38, 40. The back panel section 34 would be filled by the combined partial sections resulting from the injection application of the fill holes in the direction indicated in FIG. 11.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for filling the internal cavity of an appliance cabinet with an expanding foam material, comprising:

defining a pattern of fill holes in an outer wall of the appliance cabinet at defined locations for injecting foam into identified sections of the cavity; and injecting measured quantities of the foam material into the fill holes in a sequential manner starting at one end of the cabinet and working towards an opposite end of the cabinet so as to sequentially deposit measured amounts of the foam material into the cavity against previously deposited sections of foam material along the length of the cabinet while driving air within the cabinet towards a last section of the cabinet to be filled.

2. The method as in claim 1, further comprising defining a plurality of vent holes in the outer cabinet wall spaced apart along the longitudinal length of the cabinet.

3. The method as in claim 1, wherein the amount of foam material injected into each of the fill holes is determined so as to provide a uniform density of the foam material within each respective section.

4. The method as in claim 3, wherein the density of the foam material is varied between different sections of the cabinet.

5. The method as in claim 4, wherein the viscosity of the foam material is varied between different sections of the cabinet.

6. The method as in claim 4, wherein the appliance cabinet is for a refrigerator and the density of the foam material in the sections around the freezer compartment of the cabinet is different than in the sections around the fresh food compartment of the cabinet.

7. The method as in claim 1, wherein a plurality of the fill holes are disposed so as to primarily inject the foam material along the side panels of the cabinet, and a plurality of the fill holes are disposed so as to primarily inject the foam material along the back panel of the cabinet.

8. The method as in claim 7, wherein fill holes are further provided for primarily injecting the foam material along the top and bottom panels of the cabinet, wherein the process is commenced at either of the top or bottom panel and progresses towards the opposite respective bottom or top panel.

9. The method as in claim 1, wherein the amount of foam material to be injected into each of the identified sections of the cabinet is empirically determined or computer modeled.

10. The method as in claim 1, wherein the sequential injecting steps are preformed so that the previously injected amount of foam material does not solidify before the adjacent section of the cabinet is injected with foam material to prevent skin formation in the foam material between the different sections.

* * * * *